US005222560A

United States Patent [19]

Brammer et al.

[11] Patent Number: 5,222,560

[45] Date of Patent: Jun. 29, 1993

[54] FULL BORE INTERNAL TIEBACK SYSTEM AND METHOD

[75] Inventors: Norman Brammer, Fyvie Turiff; Stanley Hosie, Fraserburgh, both of Scotland

[73] Assignee: ABB Vetco Gray Inc., Houston, Tex.

[21] Appl. No.: 870,021

[22] Filed: Apr. 17, 1992

[51] Int. Cl.[5] ..... E21B 33/038; F16L 35/00; F16L 57/00

[52] U.S. Cl. ..... 166/344; 166/341; 285/24; 285/39; 285/397

[58] Field of Search ..... 166/341, 344, 345, 368; 285/18, 24, 39, 397, 308, 920

[56] References Cited

U.S. PATENT DOCUMENTS

| | | | |
|---|---|---|---|
| 4,343,495 | 8/1982 | Nobileau et al. | 285/23 |
| 4,681,166 | 7/1987 | Cuiper | 166/345 |
| 4,696,493 | 9/1987 | Brammer | 285/3 |
| 4,893,842 | 1/1990 | Brammer | 285/39 X |
| 4,903,993 | 2/1990 | Brammer | 285/24 |
| 4,919,454 | 4/1990 | Caulfield et al. | 285/24 X |
| 4,941,691 | 7/1990 | Reimert | 285/39 |
| 4,976,458 | 12/1990 | Hosie et al. | 285/24 |

*Primary Examiner*—Stephen J. Novosad
*Attorney, Agent, or Firm*—James E. Bradley

[57] ABSTRACT

A subsea well assembly has ability to receive an internal tieback connector when providing full bore access. The subsea well assembly has an inner wellhead housing which has a counterbore at its upper end. A tieback profile is formed in the counterbore. A protective sleeve releasably secures the counterbore, covering the tieback profile. After drilling is completed and tieback installation begins, the protective sleeve is removed. An internal tieback sleeve carried by a tieback funnel engages the tieback profile in the counterbore to secure the tieback funnel to the inner wellhead housing.

13 Claims, 3 Drawing Sheets

FULL BORE INTERNAL TIEBACK SYSTEM AND METHOD

BACKGROUND OF THE INVENTION

1. Field of the Invention

This invention relates in general to subsea well drilling, and in particular to an apparatus and method for a tieback of a subsea wellhead housing to a production tree at the surface.

2. Description of the Prior Art

In one type of subsea well drilling, a floating vessel will drill the well, cap the well, and then move from the location. Subsequently, the well will be completed by a tieback to a production platform at the surface. In this method, the subsea well will have an outer wellhead housing at the sea floor located at the upper end of a string of large diameter conductor pipe which extends into the well. An inner wellhead housing lands in the outer wellhead housing. Casing secured to the inner wellhead housing extends to a greater depth in the well than the conductor pipe.

The operator drills through the inner wellhead housing to an even greater depth and installs another string of casing. This string of casing is supported by a casing hanger that lands and seals in the inner wellhead housing. Frequently, the operator will then drill to a final depth and install another string of casing supported by another casing hanger which will land in the inner wellhead housing and seal to the bore of the inner wellhead housing. Then, the floating drilling vessel will cap the well and move from the location.

At a later date, a production platform will be installed at the surface in one type of offshore production. The operator will lower a funnel onto the inner wellhead housing, the funnel being located on the lower end of a string of riser. One type of tieback utilizes an external connector that connects the riser to the inner wellhead housing. Another type utilizes an internal connector to connect the funnel and lower end of the riser to the inner wellhead housing. The internal type is generally less expensive, however it has a bore which is smaller than that of the wellhead housing and therefore restricts access to the casing hangers suspended inside the wellhead housing.

An internal wellhead housing tieback connector is shown in U.S. Pat. No. 4,976,458, issued Dec. 11, 1990, Stanley Hosie et al. It employs a lockdown sub or tieback sleeve that is carried in an upper position and will move to a lower position when engaged by a running tool. In the lower position, the tieback sleeve will engage a tieback profile formed in the bore of the inner wellhead housing to tightly pull the funnel into engagement with the rim of the inner wellhead housing. The inner diameter of the tieback sleeve is less than the bore of the inner wellhead housing. While this is workable, in some circumstances, operators may wish to have full bore access to the inner wellhead housing.

SUMMARY OF THE INVENTION

An internal tieback system is provided with this invention that has full bore access for the inner wellhead housing bore. The system utilizes an inner wellhead housing which has a counterbore formed in the bore with a greater diameter than the bore immediately below the counterbore. The counterbore locates at the upper end and extends downward from the rim. A tieback profile will be located in the counterbore. A protective sleeve releasably secures to the counterbore and covers the tieback profile during the drilling of the well. The protective sleeve has an inner diameter that is the same as the inner wellhead housing bore.

When it is desired to install the tieback system, the operator retrieves the protective sleeve. The operator lowers a tieback funnel onto the rim in a conventional manner. A tieback sleeve carried by the tieback funnel has a profile on its exterior that will engage the tieback profile formed in the counterbore. The bore of the tieback sleeve is at least equal to the bore of the inner wellhead housing.

DETAILED DESCRIPTION OF THE INVENTION

Figure 1:
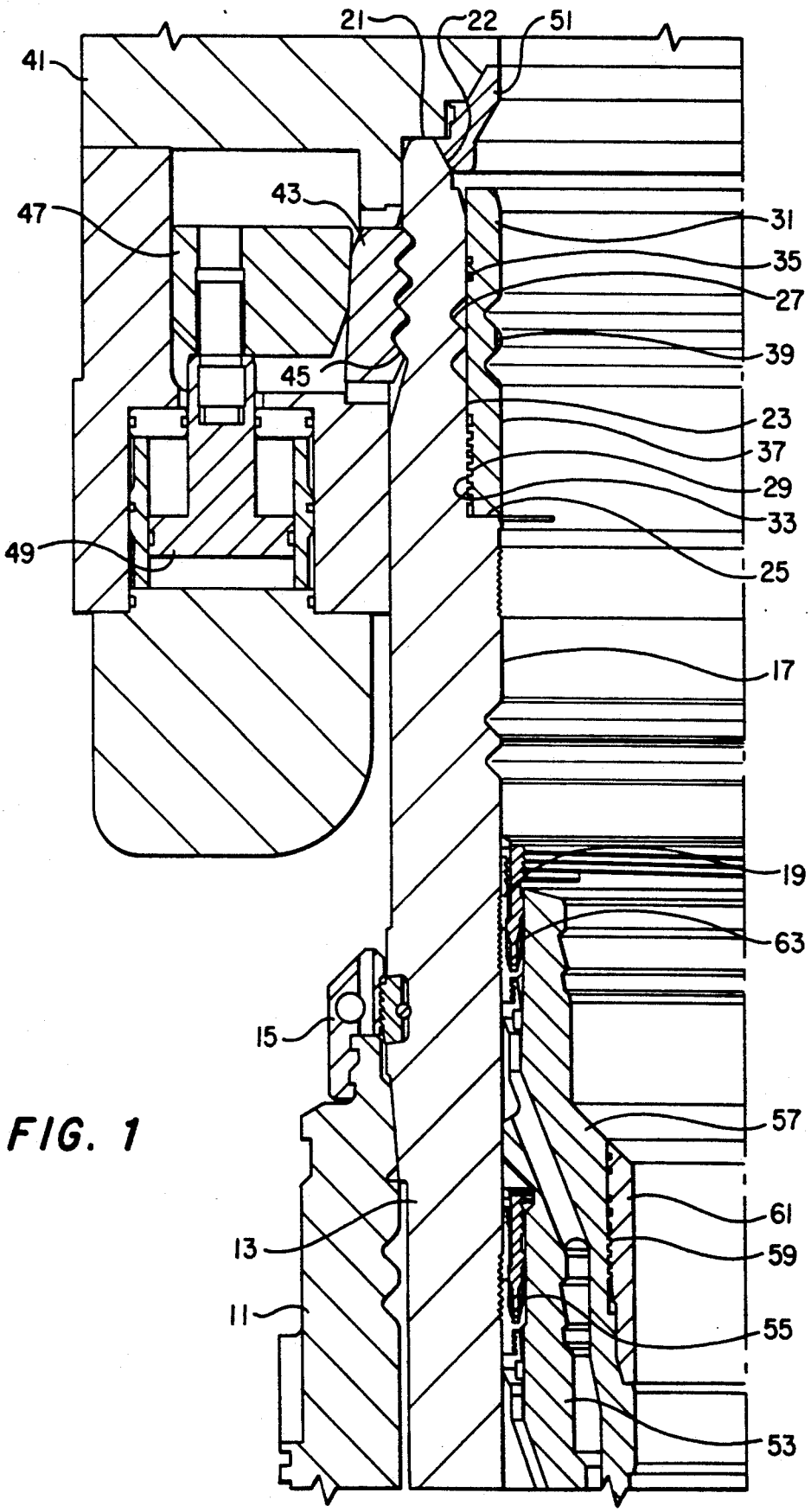
FIG. 1 is a partial quarter sectional view illustrating a subsea well assembly constructed in accordance with this invention, and shown at the completion of drilling but prior to initiating the tieback procedure.

Referring to FIG. 1, the subsea well assembly includes a conventional outer or low pressure wellhead housing 11. Outer wellhead housing 11 is a tubular member located at the sea floor. A string of conductor pipe (not shown) will extend into the well a selected depth from outer wellhead housing 11. An inner or high pressure wellhead housing 13 lands in outer wellhead housing 11. Inner wellhead housing 13 secures to a string of casing (not shown) which extends to an even greater depth in the well. A conventional latch 15 will latch inner wellhead housing 13 to outer wellhead housing 11.

Inner wellhead housing 13 has an axial bore 17. Bore 17 has at least two sealing areas 19. In the embodiment shown, each sealing area 19 comprises a set of wickers, which are small triangular shaped parallel grooves. The sealing areas 19 could also be smooth bore sections of bore 17. Inner wellhead housing 13 has a rim 21 on its upper end, which has an internal bevel or conical sealing surface 22. A counterbore 23 extends downward from rim 21. Counterbore 23 is cylindrical and has a greater diameter than bore 17, including the portion containing sealing areas 19. Counterbore 23 has an upward facing shoulder 25 on its lower end.

A tieback profile 27 is formed in counterbore 23. Tieback profile 27 in the embodiment shown comprises a pair of parallel generally triangular grooves extending circumferentially around counterbore 23. A set of threads 29 is in counterbore 23 below tieback profile 27, terminating just above shoulder 25.

A protective sleeve 31 will be installed in counterbore 23 prior to landing inner wellhead housing 13 in outer wellhead housing 11. Protective sleeve 31 has a length that is substantially the same as the distance from shoulder 25 to the conical sealing surface 22. Protective sleeve 31 has a radial thickness that is the same as the radial extent of shoulder 25. Protective sleeve 31 has an exterior that has a set of threads 33 that will engage threads 29 to connect sleeve 31 to the inner wellhead housing 13. Protective sleeve 31 has a pair of seals 35 which engage counterbore 23 above tieback profile 27.

Protective sleeve 31 has a bore 37 that has the same diameter as bore 17. A retrieval profile 39 is formed in bore 37. Retrieval profile 39 in the embodiment shown comprises a pair of grooves with splines for receiving a conventional retrieving tool (not shown) of a type which will be capable of rotating protective sleeve 31 and retrieving it to the surface. The retrieval profile 39 is the same as the running profile in a standard wellhead housing to allow standard running tools to be used to run the high pressure wellhead housing 13.

While drilling through the inner wellhead housing 13, a conventional wellhead connector 41 will be installed. Wellhead connector 41 connects inner wellhead housing 13 to a floating drilling vessel (not shown) through a string of riser. The riser will have conventional pressure control equipment. Wellhead connector 41 in the embodiment shown has a plurality of dogs 43 which will engage an exterior profile 45 formed on inner wellhead housing 13. A cam ring 47 moves axially to push the dogs 43 into profile 45. A plurality of pistons 49 when supplied with hydraulic pressure will move the cam ring 47 between upper and lower positions. A seal 51 seals wellhead connector 41 to conical sealing surface 22 of inner wellhead housing 13.

After the well has been drilled through inner wellhead housing 13 to a selected depth, a string of casing (not shown) will be lowered through inner wellhead housing 13 into the well. This string of casing is supported by a lower casing hanger 53 which lands in inner wellhead housing 13. A conventional seal 55 seals the exterior of lower casing hanger 53 to bore 17. The well is then drilled to an even greater depth, and a final string of casing (not shown) will be installed in the well. The final string of casing is supported by an upper casing hanger 57 which lands on lower casing hanger 53.

Upper casing hanger 57 has a tieback profile 59 in its bore. In the embodiment shown, tieback profile 59 comprises a set of threads. Initially a protective sleeve 61 will protect tieback profile 59. A conventional seal 63 seals the annulus surrounding casing hanger 57 to bore 17. Seal 63 engages one of the sealing areas 19.

Figure 2:
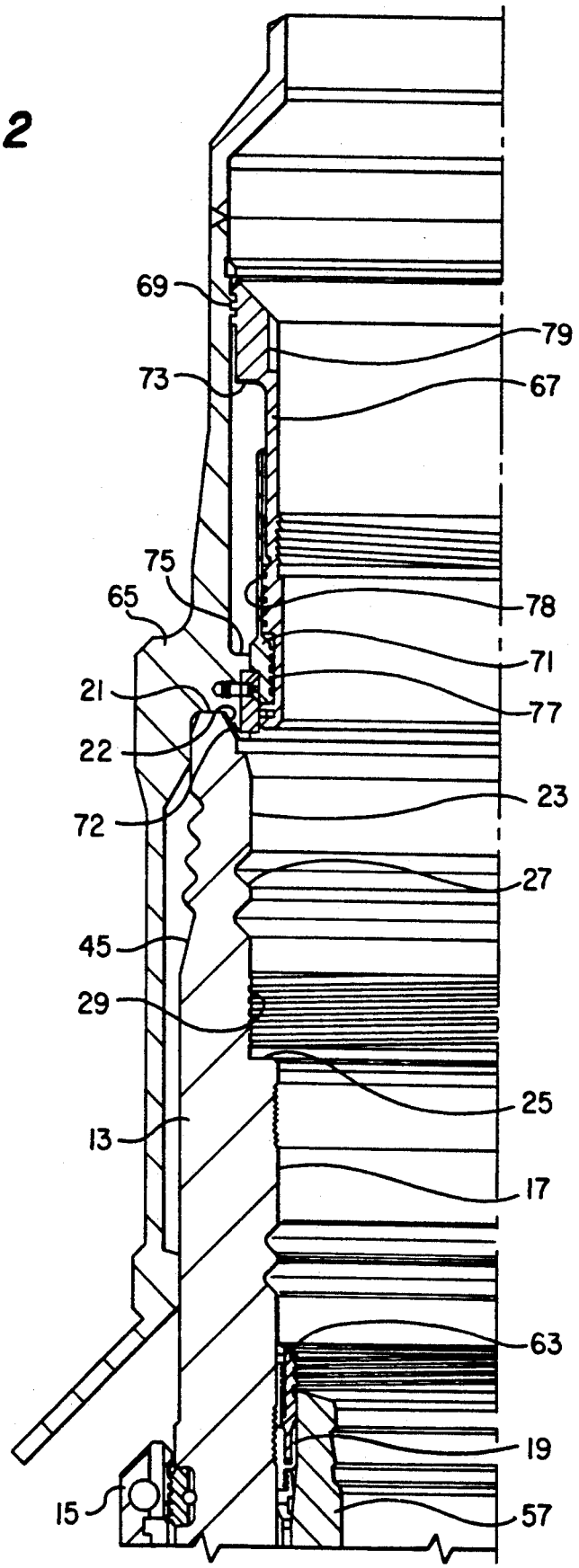
FIG. 2 is a quarter sectional view of a portion of the subsea well assembly of FIG. 1, showing the wellhead connector and the protective sleeve of FIG. 1 removed and a tieback funnel landed on but not yet connected to the inner wellhead housing.

When the floating drilling vessel has completed the subsea well to the extent shown in FIG. 1, the operator will remove the wellhead connector 41 and install a protective cap (not shown). At a later date, the operator will install a production platform over the subsea well. The operator removes the protective cap and the protective sleeve 31. The operator lowers a tieback funnel 65, as shown in FIG. 2 on a string of riser onto inner wellhead 13. Tieback funnel 65 has an upper portion that extends over the exterior of inner wellhead housing 13. The upper portion connects to the string of riser.

A lock nut or tieback sleeve 67 is carried in the interior of tieback funnel 65. The diameter of the bore of tieback sleeve 67 is the same as the diameter of bore 17 of inner wellhead housing 13. In the embodiment shown, tieback sleeve 67 is carried in an upper position initially by means of a set of retaining threads 69 located in the interior of tieback funnel 65.

Figure 3:
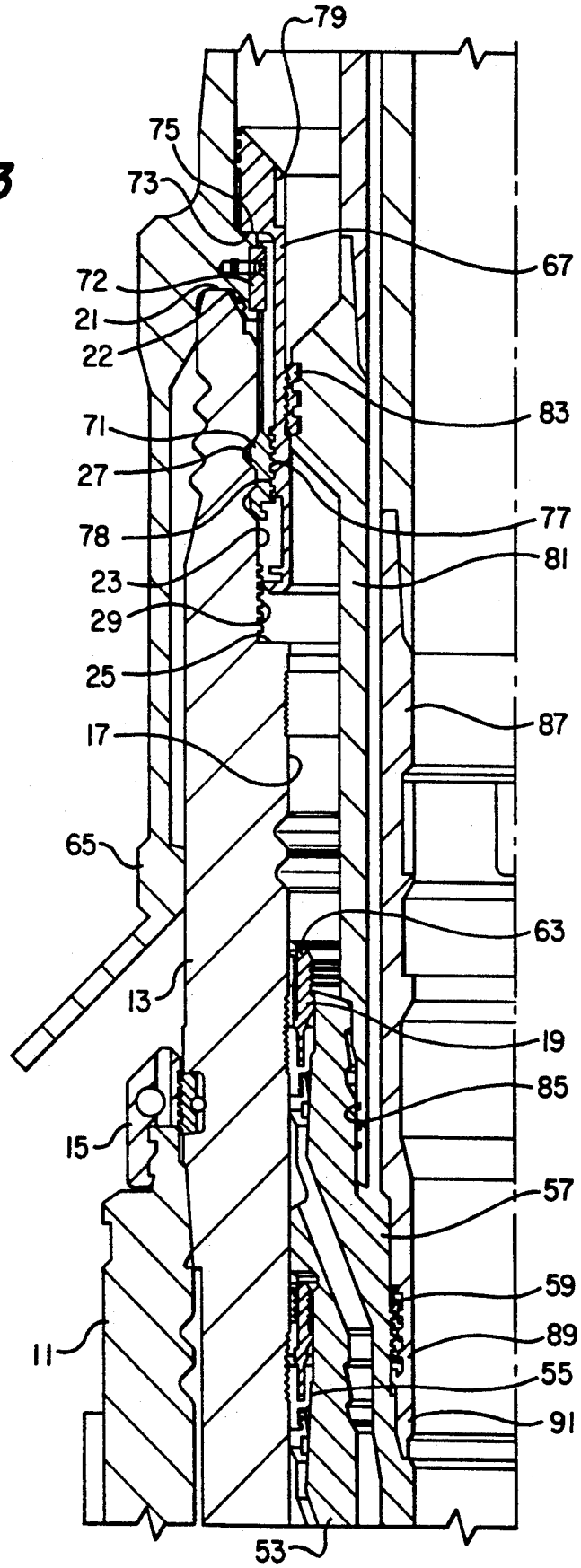
FIG. 3 is a quarter sectional view of the subsea well assembly of FIG. 1, showing the tieback funnel of FIG. 2 secured to the inner wellhead housing and showing tieback members installed in the upper casing hanger.

Tieback sleeve 67 has a locking member 71 on its exterior. Locking member 71 is a split ring with an antirotation key (not shown) located in the split. Locking member 71 has an external profile (shown in FIG. 3) that matches the tieback profile 27 formed in counterbore 23 to secure tieback sleeve 67 to inner wellhead housing 13. Alternately, a locking mechanism could be employed that utilizes threads 29 as a tieback profile rather than tieback profile 27. Locking member 71 is capable of axial movement relative to tieback sleeve 67, and is restrained from rotational movement relative to funnel 65 by a key 72 which engages splines on the locking member 71. Tieback sleeve 67 has an external downward facing shoulder 73 that engages an upward facing shoulder 75 formed in tieback funnel 65. FIG. 3 shows the shoulders 73, 75 in engagement with each other.

Locking member 71 has a set of threads 77 on the interior. Threads 77 are engaged by threads 78 formed on the exterior of tieback sleeve 67. A plurality of running tool slots 79 in the interior upper end of tieback sleeve 67 enable a running tool to be lowered from the production platform, through the riser and into engagement with the tieback sleeve 67. As illustrated by comparing FIGS. 2 and 3, the running tool rotates tieback sleeve 67 to unscrew it from threads 69, causing it to drop downward from the position shown in FIG. 2 to that shown in FIG. 3. Continued rotation causes threads 78 to engage threads 77 as the locking member 71 engages the counterbore tieback profile 27. Rotation of the tieback sleeve 67 pulls the shoulders 73, 75 into engagement with each other, and generates a compressive preload force between tieback funnel 65 and inner wellhead housing 13 at rim 21.

Referring still to FIG. 3, after the tieback funnel 65 is secured, conventional tieback equipment is employed to tie back the casing. This includes an outer tieback member 81 that has a latch 83 that latches in grooves provided in the interior of tieback sleeve 67. Outer tieback member 81 has seals 85 on its lower end that engage the bore of upper casing hanger 57. Outer tieback member 81 secures to casing which extends to the production platform. An inner tieback member 87 is lowered on a string of casing through outer tieback member 81. Inner tieback member 87 has a latch 89 that engages the tieback profile 59 in upper casing hanger 57. Inner tieback member 87 has a lower sealing end 91 that seals a lower portion of the bore of lower casing hanger 53.

In operation, a floating vessel will drill the well conventionally, then install the components shown in FIG. 1. The inner wellhead housing 13 will be landed in outer wellhead housing 11. While drilling through inner wellhead housing 13, protective sleeve 31 will protect the tieback profile 27. Casing hangers 53 and 57 will support strings of casing which are cemented in place in the well. Seals 55 and 63 will seal the casing hangers 53 and 57 to bore 17 of inner wellhead housing 13.

During the drilling and running of casing, the protective sleeve 31 will remain secured to counterbore 23, covering tieback profile 27. As the bore of the protective sleeve 31 has the same diameter as the bore 17, running and test tools which require full bore access can be utilized during drilling operations. The casing hangers 53 and 57 will be of an external diameter that is only slightly less than the full diameter of bore 17 and will be run through the protective sleeve 31. Once the drilling has been completed, the operator will remove the wellhead connector 41 and install a conventional cap (not shown). The operator will move the floating drilling vessel from the location.

Then, once a production platform has been positioned, the operator will remove the cap and remove the protective sleeve 31. The operator will use a conventional retrieval tool which will engage the retrieval profile 39 to unscrew protective sleeve 31 from threads 29.

Then the operator will lower tieback funnel 65 as illustrated in FIG. 2. The operator lowers a running tool through tieback funnel 65 to engage slots 79 in tieback sleeve 67. The operator rotates the running tool to cause the tieback sleeve 67 to unscrew from threads 69 and drop to a lower position. The locking member 71 will engage tieback profile 27. Continued rotation of the tieback sleeve 67 relative to the locking member 71 will cause the threads 77, 78 to tightly secure funnel 65 to inner wellhead housing 13. This position is shown in FIG. 3. The operator then runs conventional tieback members 81 and 87. Tieback member 81 will latch to tieback sleeve 67. Tieback member 87 will latch to upper casing hanger 57.

The invention has significant advantages. The counterbore and protective sleeve provide full bore access to the inner wellhead housing during drilling and casing running operations. This allows the use of standard running and test tools during drilling operations. It allows the operator to utilize conventional full diameter casing hangers without retrieving the protective sleeve. The protective sleeve also provides full bore access after the tieback is completed. This allows an operator to utilize an internal tieback, but still have available the possibility of retrieval of the casing hangers that are pulled for sidetracking operations.

The protective sleeve protects the tieback profile during the drilling phase while still providing full bore access. This reduces the possibility of damage to the tieback profile during drilling. The threads for the protective sleeve could also be used for a tieback operation in the event that the grooved tieback profile became damaged.

While the invention has been shown in only one of its forms, it should be apparent to those skilled in the art that it is not so limited, but is susceptible to various changes without departing from the scope of the invention.

We claim:

1. In a subsea well assembly having a tubular wellhead housing having a bore, the improvement comprising in combination:

a counterbore in the bore of the wellhead housing, the counterbore having a greater diameter than a diameter of the bore immediately below the counterbore;

a tieback profile in the counterbore;

a protective sleeve releasably secured in the counterbore and covering the tieback profile, the protective sleeve being movable to expose the tieback profile when it is desired to tieback the subsea well assembly;

a tieback funnel which is configured to land on the rim of the wellhead housing when it is desired to tieback the subsea well assembly; and a tieback sleeve carried by the tieback funnel, having a profile on its exterior which is configured to engage the tieback profile in the counterbore after the protective sleeve has been moved to secure the tieback funnel to the wellhead housing, the tieback sleeve having a bore that has a diameter at least equal to the diameter of the bore immediately below the counterbore.

2. The subsea well assembly according to claim 1 wherein the protective sleeve has a bore that is at least equal to the diameter of the bore immediately below the counterbore.

3. The subsea well assembly according to claim 1 wherein the protective sleeve is configured to be moved from covering the tieback profile by retrieving the protective sleeve from the wellhead housing.

4. The subsea well assembly according to claim 1 wherein:

the counterbore has a set of threads axially spaced from the tieback profile; and the protective sleeve has a set of threads on its exterior for releasably engaging the threads of the counterbore.

5. The subsea well assembly according to claim 1 wherein:

the profile comprises at least one circumferentially extending groove; wherein the counterbore has a set of threads axially spaced from the tieback profile; and the protective sleeve has a set of threads on its exterior for releasably engaging the threads of the counterbore.

6. In a subsea well assembly having a tubular wellhead housing having a bore terminating in an upper rim, a casing hanger supported in the bore, and a seal sealing the casing hanger to a sealing area in the bore, the improvement comprising in combination:

a counterbore in the bore of the wellhead housing, extending downward from the rim a selected distance, the counterbore having a greater diameter than a diameter of the sealing area of the bore;

a tieback profile in the counterbore;

a protective sleeve releasably secured in the counterbore and covering the tieback profile, the protective sleeve having a bore that has a diameter at least equal to the diameter of the sealing area of the bore;

retrieving means for allowing the protective sleeve to be retrieved from the wellhead housing to expose the tieback profile when it is desired to tieback the subsea well assembly;

a tieback funnel which is configured to land on the rim of the wellhead housing after the protective sleeve has been retrieved; and a tieback sleeve carried by the tieback funnel, having a profile on its exterior which is configured to engage the tieback profile in the counterbore to secure the tieback funnel to the wellhead housing, the tieback sleeve having a bore that has a diameter at least equal to the diameter of the sealing area of the bore.

7. The subsea well assembly according to claim 6 wherein the retrieving means comprises:

an engaging profile formed in the bore of the protective sleeve for engagement by a retrieval tool to release the protective sleeve from the engaging profile of the counterbore.

8. The subsea well assembly according to claim 6 wherein the retrieving means comprises:

a connecting profile formed in the counterbore axially spaced from the tieback profile;

a connecting profile on the exterior of the protective sleeve for releasably engaging the connecting profile of the counterbore; and an engaging profile formed in the bore of the protective sleeve for engagement by a retrieval tool to release the connecting profile of the protective sleeve from the connecting profile of the counterbore.

9. The subsea well assembly according to claim 6 wherein:

the tieback profile comprises at least one circumferentially extending groove; and wherein the retrieving means comprises:

a set of threads formed in the counterbore axially spaced from the tieback profile;

a set of threads on the exterior of the protective sleeve for releasably engaging the threads of the counterbore; and an engaging profile formed in the bore of the protective sleeve for engagement by a retrieval tool to unscrew the threads of the protective sleeve from the threads of the counterbore.

10. In a subsea well assembly having a tubular wellhead housing having a bore terminating in an upper rim, a casing hanger supported in the bore, and a seal sealing the casing hanger to a sealing area in the bore, the improvement comprising in combination:

a counterbore in the bore of the wellhead housing, extending downward from the rim a selected distance, the counterbore having a greater diameter than a diameter of the sealing area of the bore;

a tieback profile in the counterbore;

a connecting profile in the counterbore axially spaced from the tieback profile;

a protective sleeve having an exterior containing a connecting profile which releasably connects the protective sleeve to the connecting profile in the counterbore, covering the tieback profile, the protective sleeve having a bore that has a diameter at least equal to the diameter of the sealing area of the bore;

a retrieving profile in the bore of the protective sleeve for engagement by a retrieval tool to allow the protective sleeve to be retrieved from the wellhead housing to expose the tieback profile when it is desired to tieback the subsea well assembly;

a tieback funnel which is configured to land on the rim of the wellhead housing after the protective sleeve has been retrieved; and a tieback sleeve carried by the tieback funnel for movement between an upper position and a lower position, the tieback sleeve having a profile on its exterior which is configured to engage the tieback profile in the counterbore when the tieback sleeve is in the lower position, the tieback sleeve having a bore that has a diameter at least equal to the diameter of the sealing area of the bore.

11. The subsea well assembly according to claim 10 wherein the connecting profile of the counterbore comprises a set of threads.

12. In a method of drilling and tying back a subsea well which includes the steps of installing an outer wellhead housing with conductor pipe extending into the well, then drilling the well to a greater depth, the improvement comprising:

providing an inner wellhead housing with a bore, a rim, a counterbore extending downward from the rim, a tieback profile in the counterbore, and a sealing area located below the counterbore and being of a smaller diameter than the diameter of the counterbore;

releasably installing a protective sleeve in the counterbore so as to cover the tieback profile;

securing a string of casing to the inner wellhead housing and landing the inner wellhead housing in the outer wellhead housing;

drilling the well to a greater depth with the protective sleeve located in the counterbore;

securing another string of casing to a casing hanger, landing the casing hanger in the inner wellhead housing, cementing the second string of casing in the well, and sealing the casing hanger to the sealing area of the bore of the inner wellhead housing; then, when it is desired to tieback the well, retrieving the protective sleeve; then providing a tieback funnel with a tieback sleeve which has a bore at least equal to the diameter of the sealing area of the bore of the inner wellhead housing, and landing the tieback funnel on the rim of the wellhead housing; and engaging the tieback sleeve with the tieback profile in the counterbore to secure the tieback funnel to the wellhead housing.

13. The method according to claim 12 wherein the protective sleeve is installed in the counterbore of the inner wellhead housing by a set of threads, and retrieved from the counterbore by rotating the protective sleeve.

* * * * *